US011145186B2

(12) United States Patent
De Blonde et al.

(10) Patent No.: US 11,145,186 B2
(45) Date of Patent: Oct. 12, 2021

(54) CONTROL PANEL FOR PROCESSING A FAULT ASSOCIATED WITH A THERMOGRAPHIC DETECTOR DEVICE OF A FIRE ALARM CONTROL SYSTEM

(71) Applicant: Honeywell International Inc., Morris Plains, NJ (US)

(72) Inventors: Johnny Julien De Blonde, Oostduinkerke (BE); Uroj Usmani, Lausanne (CH); Marco Di Nubila, Lausanne (CH); Scott Lang, Geneva, IL (US); Matthew John Naylor, Myrtle Bank (AU)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/552,289

(22) Filed: Aug. 27, 2019

(65) Prior Publication Data

US 2021/0065535 A1 Mar. 4, 2021

(51) Int. Cl.

| | |
|---|---|
| ***G08B 21/00*** | (2006.01) |
| ***G08B 29/14*** | (2006.01) |
| ***G08B 29/12*** | (2006.01) |
| ***G08B 17/12*** | (2006.01) |

(52) U.S. Cl.

CPC ..... *G08B 29/145* (2013.01); *G08B 17/125* (2013.01); *G08B 29/126* (2013.01)

(58) Field of Classification Search

CPC ... G08B 29/145; G08B 29/126; G08B 17/125
USPC ..... 340/507, 628
See application file for complete search history.

(56) References Cited

U.S. PATENT DOCUMENTS 4,774,510 A * 9/1988 Steinke ..... G08B 25/14 340/3.42
5,059,953 A * 10/1991 Parsons ..... G08B 17/12 340/578
5,831,546 A * 11/1998 Costa ..... G08B 25/018 340/9.16
7,782,197 B2 8/2010 Lang et al.
(Continued)

FOREIGN PATENT DOCUMENTS

CN 102496235 B 7/2013
EP 2492883 A1 8/2012
(Continued)

OTHER PUBLICATIONS

FLIR, "Thermal Imaging Cameras for Warehouse Asset Protection", https://www.flir.in/discovery/instrumentws/manufacturing/thermal-imaging-cameras-for-warehouse-asset-protection/, accessed May 28, 2019, (12 pages).

*Primary Examiner* — Mark S Rushing
(74) *Attorney, Agent, or Firm* — Brooks, Cameron & Huebsch, PLLC

(57) ABSTRACT

A control panel for a fire alarm control system is described herein. In some examples, one or more embodiments include a memory and a processor to execute instructions stored in the memory to receive a fault signal from a thermographic detector device, wherein the fault signal corresponds to a fault associated with the thermographic detector device, wherein the fault signal is associated with at least one of a field of view fault, an operating parameter fault, an internal fault, and a transmission fault, and provide a notification of the fault using the fault signal.

20 Claims, 5 Drawing Sheets

(56) References Cited

U.S. PATENT DOCUMENTS

| | | | | |
|---|---|---|---|---|
| 9,569,945 | B2 | 2/2017 | Zumsteg et al. | |
| 9,660,050 | B1 | 5/2017 | Wu et al. | |
| 9,666,050 | B2 * | 5/2017 | Wu | G08B 17/125 |
| 2002/0021221 | A1 * | 2/2002 | Okamoto | G08B 17/125 340/577 |
| 2006/0115154 | A1 * | 6/2006 | Chen | G08B 17/125 382/181 |
| 2006/0244837 | A1 | 11/2006 | Ekeroth et al. | |
| 2007/0001819 | A1 * | 1/2007 | Becker | H03K 17/0822 340/286.05 |
| 2007/0115111 | A1 * | 5/2007 | Girouard | G08B 29/06 340/507 |
| 2015/0084780 | A1 * | 3/2015 | Palmer | G08B 29/181 340/693.1 |
| 2015/0348399 | A1 * | 12/2015 | Cree | G06F 3/0488 340/514 |
| 2016/0171857 | A1 * | 6/2016 | Zumsteg | G08B 29/04 340/628 |
| 2019/0244504 | A1 * | 8/2019 | Ebata | G08B 17/125 |
| 2021/0020013 | A1 | 1/2021 | De Blonde et al. | |

FOREIGN PATENT DOCUMENTS

| | | | |
|---|---|---|---|
| KR | 101148799 | B | 5/2012 |
| KR | 101251942 | B1 | 4/2013 |
| WO | 2000063863 | A1 | 10/2000 |

* cited by examiner

CONTROL PANEL FOR PROCESSING A FAULT ASSOCIATED WITH A THERMOGRAPHIC DETECTOR DEVICE OF A FIRE ALARM CONTROL SYSTEM

TECHNICAL FIELD

The present disclosure relates generally to a control panel for a fire alarm control system.

BACKGROUND

Facilities, such as commercial facilities, office buildings, airports, hospitals, and the like, may have fire alarm control systems that can be used during an emergency situation (e.g., a fire) to manage a fire event in and/or around the facility. For example, a fire alarm control system may include sensors such as smoke detectors, heat detectors, and flame detectors, among other types of sensors, as well as control equipment such as fire alarm control panels. However, the environment of such facilities may present various challenges, such as dust, steam, etc., to the operational capabilities of the fire alarm control system.

DETAILED DESCRIPTION

Figure 1:
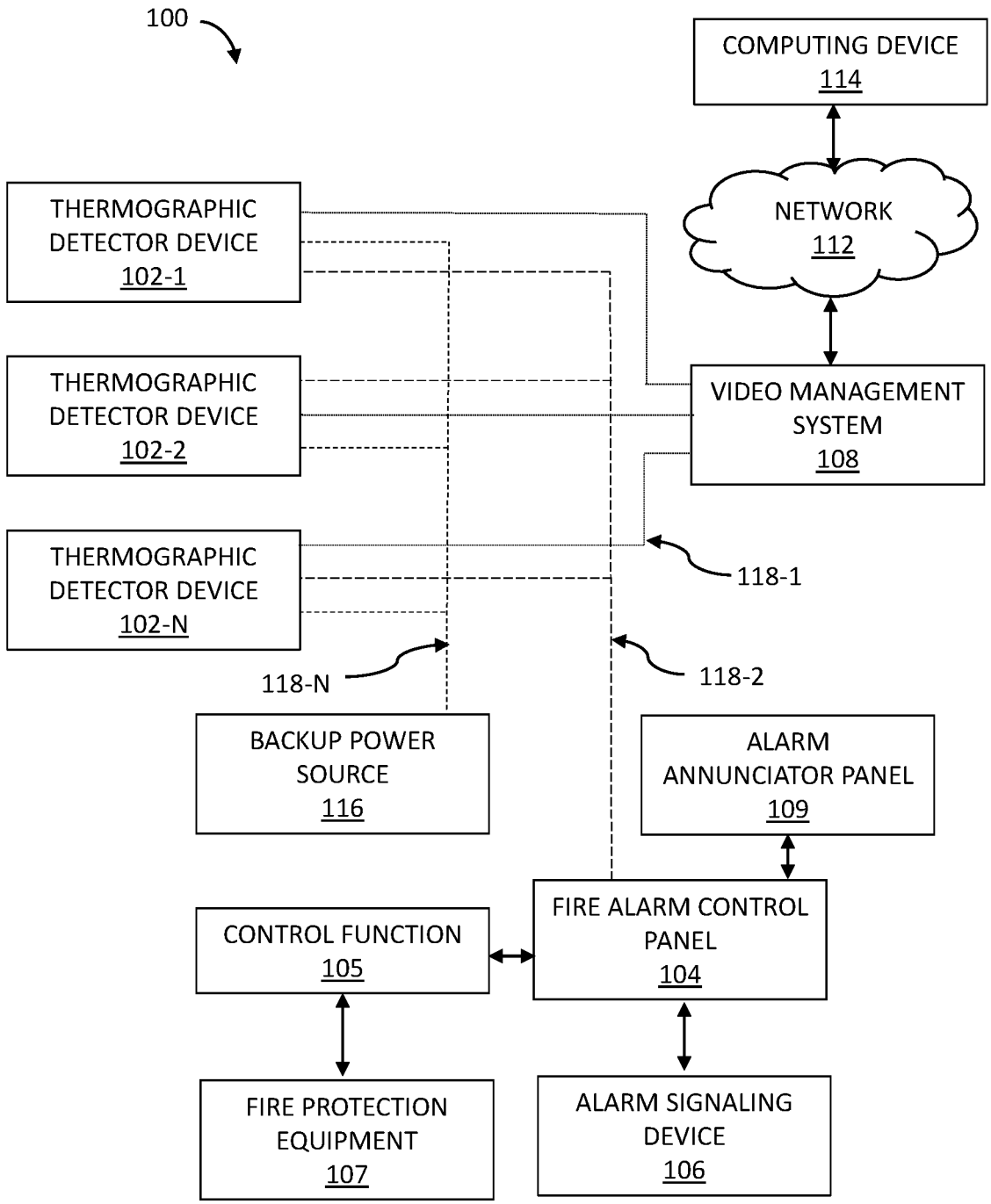
FIG. 1 is an example of an illustration of a fire alarm control system, in accordance with one or more embodiments of the present disclosure.

A control panel for a fire alarm control system is described herein. In some examples, one or more embodiments include a control panel, comprising a memory and a processor to execute instructions stored in the memory to receive a fault signal from a thermographic detector device, wherein the fault signal corresponds to a fault associated with the thermographic detector device, wherein the fault signal is associated with at least one of a field of view fault, an operating parameter fault, an internal fault, and a transmission fault, and provide a notification of the fault using the fault signal.

Previous control panels for fire alarm control systems may only receive and/or provide a notification of limited types of faults associated with a detector device and/or the control panel, or may not be able to receive or provide a notification of such faults at all. For example, previous control panels may receive or provide a notification of one type of fault, but may fail to receive or provide a notification of other types of faults. Thus, these control panels may not be capable of performing continuous and uninterrupted operation. As such, a fire alarm control system using such a control panel can fail to provide a notification of a fault associated with the detector device and/or a notification of an emergency situation. Failure to provide a notification of the fault or the emergency situation to a user may result in a failure to trigger and sound an alarm warning occupants of a facility.

In contrast, a control panel for a fire alarm control system in accordance with the present disclosure can allow for immediate failsafe fault detection by being able to receive or provide a notification of one or more of a plurality of different types of faults. For example, the control panel can receive a fault signal such as, for instance, a trouble signal, from a thermographic detector device, where the fault signal corresponds to a fault associated with the thermographic detector device that may be, for instance, a field of view fault, an operating parameter fault, an internal fault, or a transmission fault. Upon receiving the fault signal, the control panel can provide a notification of the fault using the fault signal.

In some cases, the control panel can send information associated with the detected fault and/or information associated with a detected emergency situation (e.g., a fire) to a computing device (e.g., a desktop or mobile device) to provide a notification of the detected fault and/or detected emergency situation. This can allow for users and/or occupants to easily determine that there is a fault associated with the thermographic detector device and, in some cases, what type of detected fault. As such, a user can more easily identify a fault and remotely monitor the fire alarm control system, allowing the user to make informed decisions regarding maintenance, saving on time, effort, and money. Further, this can provide information to users and/or occupants that can provide guidance on how to best handle an emergency situation, such as, for instance, possible actions to take in response to the emergency situation and/or evacuation routes. Further, such failsafe fault detection can ensure that the thermographic detector device is operating continuously and uninterrupted. Thus, in an emergency situation, occupants of the facility will receive a visual and/or audio notification, along with information that can be used to determine how to handle the emergency situation.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component. Additionally, the designator "N" as used herein, particularly with respect to reference numerals in the drawings, indicates that a number of the particular feature so designated can be included with a number of embodiments of the present disclosure. This number may be the same or different between designations.

FIG. 1 is an example of an illustration of a fire alarm control system 100, in accordance with one or more embodiments of the present disclosure. The fire alarm control system 100 can be the fire alarm control system of a facility (e.g., building), such as, for instance, a large facility having a large number of floors, such as a commercial facility, office building, airport, hospital, and the like. However, embodiments of the present disclosure are not limited to a particular type of facility.

Fire alarm control system 100 can include a plurality of components located throughout a facility (e.g., on different floors of the facility) that can be used to detect and/or manage a fire (e.g., heat and/or flame of the fire) occurring in the facility, and/or to prevent a fire from occurring in the facility. For example, the plurality of components may include thermographic detector devices 102-1, 102-2, . . . , 102-N that can sense a fire occurring in the facility, alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components.

As shown in FIG. 1, fire alarm control system 100 can include a plurality of thermographic detector devices 102-1, 102-2, . . . , 102-N installed within the facility. Each of the respective thermographic detector devices 102-1, 102-2, . . . , 102-N can include any type of thermography camera (e.g., thermographic imager, microbolometer, radiometric detector, etc.) configured to capture (e.g., detect) thermal images of a monitored area (e.g., an area within a field of view of the thermography camera lens) allowing for early detection of smoke and/or fire within a facility. For example, thermography cameras can form a heat zone image using long wave infrared (LWIR) radiation. The relationship between a surface of a body and the intensity of its emitted radiation can be used to determine the temperature of an object or area without physical contact. Additionally, thermographic detector devices 102-1, 102-2, . . . , 102-N may be configured to detect flames within the monitored areas of thermographic detector devices 102-1, 102-2, . . . , 102-N and provide video information to visualize the monitored area.

Thermographic detector devices 102-1, 102-2, . . . , 102-N each can include a memory, and a processor configured to execute instructions stored in the memory to detect a fault associated with the thermographic detector device. As described further herein (e.g., in connection with FIG. 2), the fault can include at least one of a field of view fault, an operating parameter fault, internal fault, and a transmission fault. Additionally, thermographic detector devices 102-1, 102-2, . . . , 102-N can be configured to generate a fault signal upon detecting the fault and provide a notification of the fault using the fault signal. For instance, the thermographic detector device can provide a notification of the fault to a user by sending the fault signal to a separate component of the fire alarm control system, such as a control panel, as will be further described herein. Further, the thermographic detector device can provide an alarm signal and/or thermal image to the control panel, as will be further described herein.

As shown in FIG. 1, fire alarm control system 100 can include a control panel 104. Control panel 104 can be any different type of physical control panel, such as a control box, installed in the facility.

As used herein, the term "control panel" refers to a controlling component of a fire alarm control system. For example, a fire alarm control panel can receive information from fire hardware devices (e.g., initiating devices) in the facility, monitor operational integrity of fire hardware devices in the facility, control fire hardware devices in the facility, and/or transmit information about fire hardware devices in the facility, among other operations. As an example, a fire alarm control panel can receive information from, monitor, control, and/or transmit information about sensors in the facility. As used herein, the term "sensor" refers to devices designed to detect and report fires.

Control panel 104 can be used by a user to monitor and/or control thermographic detector devices 102-1, 102-2, . . . , 102-N, among other components of fire alarm control system 100. For instance, the user can use control panel 104 to directly control the operation of (e.g., actions performed by) thermographic detector devices 102-1, 102-2, . . . , 102-N. Further, control panel 104 can receive (e.g., collect) data, such as, for instance, the fault and/or alarm signal generated by thermographic detector devices 102-1, 102-2, . . . , 102-N. For instance, control panel 104 can receive the fault and/or alarm signal directly from thermographic detector devices 102-1, 102-2, . . . , 102-N via transmission path 118-2 by which the thermographic detector devices and the control panel are communicatively coupled.

Control panel 104 can also receive data, such as, for instance, a detected temperature, video information, and/or thermal images captured by thermographic detector devices 102-1, 102-2, . . . , 102-N. For example, minimum, maximum, and/or rate of rise levels can be associated with temperature measurement or characteristic image patterns captured by the thermographic detector devices, which can indicate that there is an emergency situation (e.g., a fire). Upon detection of the emergency situation, control panel 104 can instruct alarm signaling device 106 to provide a visual and/or audio notification to occupants of the facility. Additionally, control panel 104 can provide a visual and/or audio notification of the emergency situation via a user interface of control panel 104.

As shown in FIG. 1, fire alarm control system 100 can include control function 105 to control fire protection equipment 107. Control function 105 can refer to a controlling component of fire alarm control system 100. For example, control function 105 can receive information from control panel 104, monitor fire protection equipment 107 in the facility, and control fire protection equipment 107 in the facility, among other operations. Fire protection equipment 107 can include extinguishing water cannons and/or fire doors located within the facility for instance. Embodiments of the present disclosure, however, are not limited to a particular type(s) of fire protection equipment.

As an example, control function 105 can receive an alarm signal from control panel 104, where the alarm signal can include information associated with an emergency situation detected by thermographic detector devices 102-1, 102-2, . . . , 102-N, including a location of a fire and a magnitude, speed, and direction of the fire. Based on the alarm signal, control function 105 can instruct fire protection equipment 107 to take a particular action. For instance, control function 105 can instruct the extinguishing water cannons to discharge directly into the areas of the facility where fire has been detected by providing the extinguishing coordinates for the cannons that discharge into those areas. Control function 105 can also instruct fire doors located in areas of the facility where fire has been detected to close to contain the fire, as well as open when the fire has been extinguished. Control function 105 can also provide, based on the alarm signal, an indication of whether it is safe to use (e.g., open) the doors.

As shown in FIG. 1, fire alarm control system 100 can include alarm annunciation panel 109. As used herein, the term "alarm annunciation panel" refers to a panel that includes a blueprint of a facility along with a number of lights and displays that indicate where an emergency situation has been detected (e.g., where a fire alarm has been set off). Alarm annunciation panel 109 can receive information from control panel 104, such as an alarm signal. Based on the alarm signal control panel 104, can instruct alarm annunciation panel 109 to provide (e.g., display) a visual notification of an emergency situation (e.g., a fire). For example, a light source or display on the blueprint of the facility can notify a user where a fire has been detected.

Additionally, alarm annunciation panel 109 can provide users with a safe evacuation route, by indicating safe and unsafe (e.g., blocked and/or fire is detected) exit routes via the light sources and/or displays on the blueprint. For example, alarm annunciation panel 109 can receive information from thermographic detector devices 102-1, 102-2, . . . , 102-N indicating where there are unsafe locations so that these locations can be avoided when providing the evacuation route.

Additionally, fire alarm control system 100 can detect a transmission fault. The transmission fault can include at least one of a connectivity fault between control panel 104 and thermographic detector device 102 and a power supply fault associated with at least one of control panel 104 (e.g., a failure associated with a connection between control panel 104 and thermographic detector device 102) and thermographic detector device 102. The connection between thermographic detector device 102 and control panel 104 can contain a fault circuit for generating a fault signal and providing a notification of the fault using the fault signal. Additionally, the connection between thermographic detector device 102 and control panel 104 can contain an alarm circuit for generating an alarm signal and providing a notification of the alarm using the alarm signal. A loss of connection between thermographic detector device 102 and control panel 104 can prevent the detection and/or notification of a fault associated with the thermographic detector device. For example, the loss of connection can be caused by a short circuit in the fault circuit and/or an open circuit in the alarm circuit. Thus, fire alarm control system 100 can be configured to detect a fault associated with a connection between thermographic detector device 102 and control panel 104, and provide a notification of the fault associated with the connection.

As shown in FIG. 1, fire alarm control system 100 can include a video management system 108. Video management system 108 can be located remotely from the facility in which thermographic detector devices 102-1, 102-2, . . . , 102-N and control panel 104 are installed and, in some embodiments, can be part of and/or coupled to a computing device 114 that is part of a centralized management platform located remotely from the facility. Video management system 108 can store data received by thermographic detector devices via transmission path 118-1 by which the thermographic detector devices and the video management system are communicatively coupled. Video management system 108 can communicate with computing device 114 via network 112, as illustrated in FIG. 1. For example, video management system 108 can receive data (e.g., a fault signal, video information, and/or thermal images) from thermographic detector devices 102-1, 102-2, . . . , 102-N and send (e.g., transmit and/or upload) the data to computing device 114 via network 112.

Network 112 can be a network relationship through which video management system 108 and computing device 114 can communicate. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, network 112 can include a number of servers that receive information from, and transmit information to, video management system 108 and computing device 114 via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

As shown in FIG. 1, fire alarm control system 100 can include a backup power source 116, such as a battery backup. Backup power source 116 can be located remotely from the thermographic detector devices and the control panel, and can be located within the facility in which thermographic detector devices 102-1, 102-2, . . . , 102-N and control panel 104 are installed or remote from the facility. In an instance where there is a fault associated with the primary power source, which may be located within control panel 104, that prevents the primary power source from providing power to thermographic detector devices 102-1, 102-2, . . . , 102-N via transmission path 118-2, backup power source 116 can provide power to thermographic detector devices 102-1, 102-2, . . . , 102-N via transmission path 118-N. This can allow thermographic detector devices 102-1, 102-2, . . . , 102-N to continue to operate when there is a failure associated with the primary power source.

As shown in FIG. 1, fire alarm control system 100 can include an alarm signaling device 106. Alarm signaling device 106 can be configured to provide a notification of the fire to the occupants of the facility via a visual and/or audio notification. Alarm signaling device 106 can be installed within the facility in which thermographic detector devices 102-1, 102-2, . . . , 102-N and control panel 104 is installed. Control panel 104 can be configured to control the operation of alarm signaling device 106. For example, upon detection of an emergency situation (e.g., detecting flames within a thermal image) within the facility, control panel 104 can instruct fire signaling device 106 to provide the visual and/or audio notification.

As shown in FIG. 1, fire alarm control system 100 can include a computing device 114 configured to provide information associated with a detected fault to a user. Computing device 114 can be located remotely from the facility in which control panel 104 and thermographic detector 102 are installed allowing for a user to more easily monitor thermographic detector devices 102-1, 102-2, . . . , 102-N. Computing device 114 can receive a fault signal, an alarm signal, and/or video information from video management system 112 via network 112. The fault signal can include information associated with the fault including a time of the fault, a location of the fault, indicating information for the thermographic detector device, and a type of the thermographic detector device. Additionally, computing device 114 can receive, from video management system 108, and display images captured by thermographic detector devices 102-1, 102-2, . . . , 102-N.

As used herein, the term "computing device" can include a laptop computer, desktop computer, or mobile device, such as, for instance, a smart phone or tablet, among other types of computing devices. The computing device can include a user interface. A user can interact with the computing device via the user interface. For example, the user interface can provide (e.g., display) information to and/or receive information from (e.g., input by) the user of the computing device.

In some embodiments, user interface can be a graphical user interface (GUI) that can include a display (e.g., a screen) that can provide information to, and/or receive information from, the user of the computing device. The display can be, for instance, a touch-screen (e.g., the GUI can include touch-screen capabilities). As an additional example, the user interface can include a keyboard and/or mouse that the user can use to input information into the computing device, and/or a speaker that can play audio to, and/or receive audio (e.g., voice input) from, the user. Embodiments of the present disclosure, however, are not limited to a particular type(s) of user interface.

Figure 2:
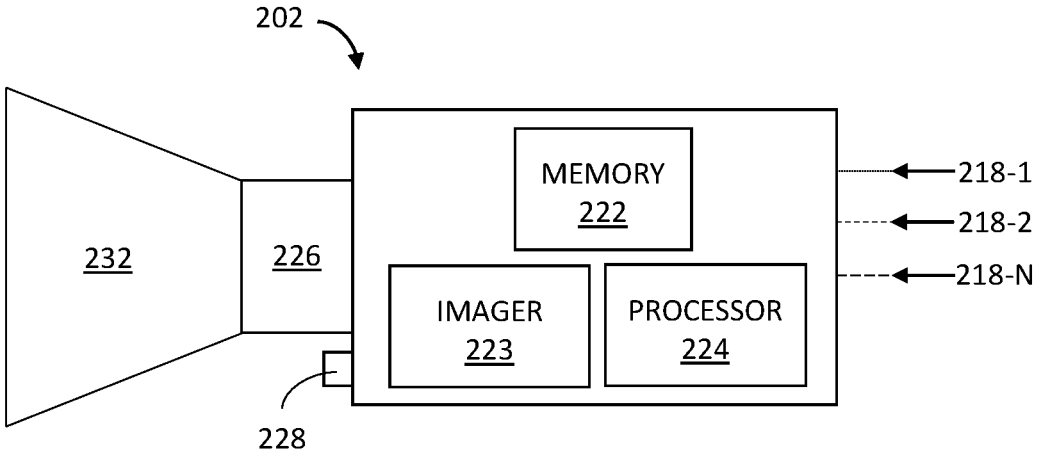
FIG. 2 is an example of an illustration of a thermographic detector device, in accordance with one or more embodiments of the present disclosure.

FIG. 2 is an example of an illustration of a thermographic detector device 202, in accordance with one or more embodiments of the present disclosure. Thermographic detector device 202 can be, for instance, the thermographic detector devices 102-1, 102-2, . . . , 102-N previously described in connection with FIG. 1.

As shown in FIG. 2, thermographic detector device 202 can include a processor 224 and a memory 222. The memory 222 can be any type of storage medium that can be accessed by the processor 224 to perform various examples of the present disclosure. For example, the memory 222-1 can be a non-transitory computer readable medium having computer readable instructions (e.g., computer program instructions) stored thereon that are executable by the processor 224 for detecting a fault associated with thermographic detector device 202 in accordance with the present disclosure.

The memory 222 can be volatile or nonvolatile memory. The memory 222 can also be removable (e.g., portable) memory, or non-removable (e.g., internal) memory. For example, the memory 222 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 222 is illustrated as being located within thermographic detector device 202, embodiments of the present disclosure are not so limited. For example, memory 222 can also be located internal to another computing resource (e.g., enabling computer readable instructions to be downloaded over the Internet or another wired or wireless connection).

Thermographic detector device 202 can be configured to detect a fault associated with thermographic detector device 202. The fault can include at least one of a field of view fault, an operating parameter fault, and an internal fault. Upon detecting the fault, thermographic detector device 202 can generate a fault signal and provide a notification of the fault using the fault signal.

In some examples, thermographic detector device 202 can be configured to determine the type of the detected fault, where the type is one of a field of view fault, an operating parameter fault, an internal fault, and a power supply fault. Upon detecting the type of the fault, thermographic detector device 202 can generate a fault signal that includes an indication of the type of the detected fault, and provide a notification of the detected fault using the fault signal.

The fault signal can be transmitted via one of the plurality of transmission paths 218-1, 218-2, . . . , 218-N within the fire alarm control system. This can allow for a user to be notified that thermographic detector device 202 and/or a separate component (e.g., a transmission path, a power source, an alarm signaling device, etc.) is not operating properly.

In an example, there can be a failure associated with a power supply of thermographic detector device 202. As previously described in connection with FIG. 1, thermographic detector device 202 can receive power from a power source, which can be a primary power supply located within a control panel or a backup power source (e.g., battery backup) located separate from or within the control panel and thermographic detector device 202. Thermographic detector device 202 can detect a failure associated with the power supply of (e.g., a drop of supply voltage to) thermographic detector device 202, such as a failure associated with the power supply functionality itself or the transmission path from the power source to thermographic detector device 202.

As shown in FIG. 2, thermographic detector device 202 can include a camera (e.g., lens) 226 with a field of view 232. As previously described, thermographic detector device 202 can capture thermal images within a monitored area of a facility. For example, thermographic detector device 202 can detect fire within the field of view 232 of the camera 226 of thermographic detector device 202. In some cases, there can be a fault that prevents thermographic detector device 202 from capturing thermal images and/or video information within field of view 232. The field of view fault can include at least one of an obstruction in the field of view, a degradation of view of thermographic detector device 202, a fault associated with a lens cleansing operation of thermographic detector device 202, and a masking of thermographic detector device 202.

In an example, there can be an obstruction in field of view 232 of thermographic detector device 202 that prevents thermographic detector device 202 from being able to permanently monitor its target area. For example, an obstruction can appear within field of view 232 and prevent thermographic detector device 202 from monitoring a target area of a facility. Additionally, field of view 232 can be degraded by an alteration of a focal length or focus of lens 226 of thermographic detector device 202. Thermographic detector device 202 can detect a fault that prevents thermographic detector device 202 from monitoring the facility, such as a fault associated with thermographic detector device's 202 ability to detect an obstruction within field of view 232, collecting or comparing the collected images, and/or detect an alteration of the focal length of lens 226 of thermographic detector device 202. For example, thermographic detector device 202 can compare a series of images collected over a period of time by thermographic detector device 202 to an image collected at the time of commission to detect such a fault.

In an example, there can be a degradation of view of thermographic detector device 202. The ability of thermographic detector device 202 to capture thermal images can be diminished below the level needed to detect or fire due to, but not limited to, contamination from dust or dirt on lens 226 of thermographic detector device 202 or environmental conditions (e.g., dust, steam, etc.) within the field of view 232 of the thermographic detector device 202. Thermographic detector device 202 can detect a degradation of view of thermographic detector device 202 that can prevent thermographic detector device 202 from detecting an emergency situation within field of view 232.

In an example, there can be a fault associated with a lens cleansing operation of thermographic detector device 202. To reduce the risk of the degradation of view of thermographic detector device 202, a lens cleansing system can be installed within the fire alarm control system. As further described herein (e.g., in connection with FIG. 4), an example of such a system can include air rings or air blades that continuously blow compressed air onto the lens 226 of thermographic detector device 202. This can keep the lens free of dust and dirt. Thermographic detector device 202 can detect a fault associated with the lens cleansing operation (e.g., a loss of continuous air flow to the lens) that can prevent the lens cleansing system from operating.

In an example, there can be a masking of thermographic detector device 202. Thermographic detector device 202 (e.g., lens 226) depends on a free field of view to operate. In an instance where lens 226 of thermographic detector device 202 is masked, thermographic detector device 202 may not be able to monitor the facility. Masking can include, but is not limited to, physically covering lens 226 or spraying an opaque liquid on lens 226. Thermographic detector device 202 can detect when thermographic detector device 202 is unable to monitor the facility as a result of masking of the lens of thermographic detector device 202. Additionally, thermographic detector device 202 can detect when thermographic detector device 202 is unable to monitor the facility as a result of a partial obstruction of the lens of thermographic detector device 202. For example, a portion of the thermal image can be obstructed by an object being placed within field of view 232.

When the fire alarm control system is installed, thermographic detector device 202 can be calibrated and installed to operate in a manner that allows for detection and management of a fire event in and/or around the facility in which the thermographic detector device 202 is installed. However, a fault associated with an operating parameter can prevent thermographic detector device 202 from detecting and managing the fire event. The operating parameter fault can include at least one of a sensitivity drift of thermographic detector device 202, a deviation of a pan and tilt unit of thermographic detector device 202, and a deviation of thermographic detector device 202 from an initial target.

In an example, there can be a sensitivity drift of thermographic detector device 202. For instance, alarm levels of the detector device can be set to a particular temperature with a determined accepted tolerance, and thermographic detector device 202 can be calibrated to operate accordingly. Thermographic detector device 202 can detect a drift of sensitivity that causes thermographic detector device 202 to deviate from these set operating parameters and wrongly detect a fire event or cause a fire event to not be detected.

In an example, there can be a deviation of a pan and tilt unit of thermographic detector device 202. Thermographic detector device 202 can include a pan-tilt-zoom camera (PTZ camera) (e.g., imager 223 can be a PTZ camera). A PTZ camera is a camera that is capable of remote directional and zoom control. In contrast to fixed position cameras, PTZ cameras may position itself to pre-determined positions and fields of view in a pre-determined time sequence. Thermographic detector device 202 can electrically or mechanically detect a deviation from the pre-determined positions, field of views, and/or time sequence which may prevent thermographic detector device 202 from monitoring the facility. For instance, the thermographic detector device can use encoders to measure and record the position of camera 226 through the sequence and/or compare recorded images from different positions during previous sequences to those of subsequent sequences.

In an example, there can be a deviation of thermographic detector device 202 from an initial target. When installed within a facility, thermographic detector device 202 can be positioned so that the area which is intended to be monitored is within field of view 232. Thermographic detector device 202 can detect when the thermographic detector device 202 has deviated from the position such that the target area is not within field of view 232. Deviation of thermographic detector device 202 from an initial target can be the result of tampering with the mechanical mounting of thermographic detector device 202, among other examples.

Additionally, there can be internal faults associated thermographic detector device 202 which prevent thermographic detector device 202 from detecting an event (e.g., a fire alarm) within the facility. The internal fault can include at least one of saturation of a thermographic detector device 202 and an internal operation fault of thermographic detector device 202.

In an example, there can be a saturation of imager 223 of thermographic detector device 202. Imager 223 can be a sensor that can detect and convey information used to produce an image by converting radiated thermal energy into signals. For instance, if thermographic detector device 202 is directly exposed to direct or indirect light sources, such as the sun, flood lights, etc., imager 223 may become saturated, which can prevent thermographic detector device 202 from operating properly. Thermographic detector device 202 can detect when imager 223 has become saturated such that thermographic detector device 202 is prevented from monitoring the facility.

In an example, there can be an internal operation fault of thermographic detector device 202. The operation of thermographic detector device 202 can involve a number of internal factors which allow for continuous monitoring and detection by thermographic detector device 202 (e.g., by camera 226). These factors can include, but are not limited to, contrast, focus, brightness, sharpness, etc. Thermographic detector device 202 can detect a fault associated with any of these factors which can prevent thermographic detector device 202 from monitoring the facility.

Upon detection of at least one of a field of view fault, an operating parameter fault, and an internal fault, thermographic detector device 202 can generate a fault signal and provide a notification of the fault using (e.g., by transmitting) the fault signal. The fault signal can include information associated with the detected fault, such as the type of the fault.

As shown in FIG. 2, thermographic detector device 202 can transmit data via a plurality of transmission paths 218-1, 218-2, . . . , 218-N. For instance, upon generating the fault and/or alarm signal, thermographic detector device 202 can send the fault and/or alarm signal to a separate component of the fire alarm control system to provide a notification of the fault and/or alarm to a user, as previously described (e.g., in connection with FIG. 1). For example, thermographic detector device 202 can send the fault and/or alarm signal to a control panel, such as control panel 104 described in FIG. 1, via transmission path 218-2. Thermographic detector device 202 can also send the fault signal to a centralized system (e.g., video management system 108, as described in FIG. 1) via transmission path 218-1.

Additionally, thermographic detector device 202 can receive power via transmission path 218-N. For example, as previously described (e.g., in connection with FIG. 1), the fire alarm control system can include a power source that is located within or separate from the control panel. The power source can include a primary power source and/or a backup power source (e.g., a battery backup). In an instance where there is a fault associated with the primary power source (e.g., the primary power source no longer provides power to thermographic detector device 202), the secondary power source can transmit power to thermographic detector device 202.

Thermographic detector device 202 can also transmit data associated with the operation of thermographic detector device 202 to a control panel and/or a video management system. For example, thermographic detector device 202 can send video information to the video management system. The video information can include images that can allow a user to visualize the area monitored by thermographic detector device 202.

As shown in FIG. 2, thermographic detector device 202 can include a light source 228 configured to provide a notification of a detected fault. For example, light source 228 can be a light emitting diode (LED) or any other type of light source that can provide a notification of the detected fault and/or alarm. Upon detecting the fault or alarm, thermographic detector device 202 can generate a fault signal or alarm signal and notify a user of the detected fault or alarm, via illuminating light source 228. This can allow a user to more easily be notified that there is a fault associated with thermographic detector device 202 and that maintenance is needed. Alarm notification via light source 228 may take priority over fault notification via light source 228 when there is a detected fault and alarm occurring simultaneously.

Figure 3:
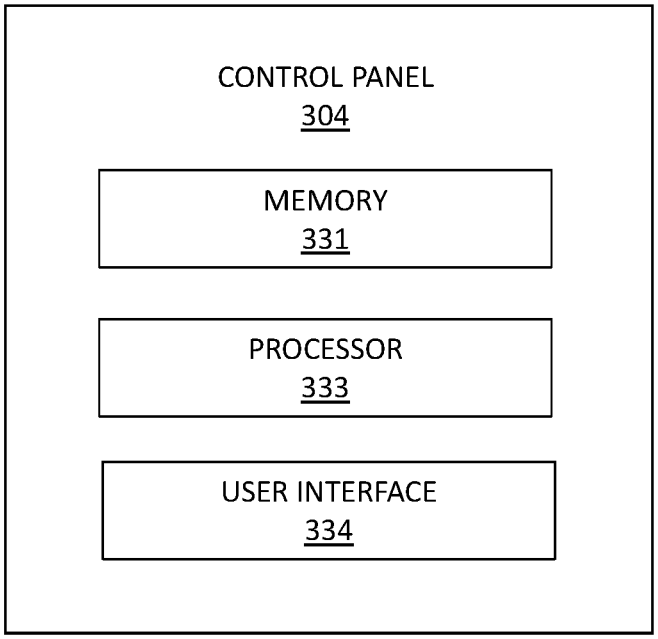
FIG. 3 is an example of an illustration of a control panel, in accordance with one or more embodiments of the present disclosure.

FIG. 3 is an example of an illustration of a control panel 304, in accordance with one or more embodiments of the present disclosure. Control panel 304 can be, for instance, the control panel 104 previously described in connection with FIG. 1.

As shown in FIG. 3, control panel 304 can include a processor 333, a memory 331, and a user interface 334. The memory 331 can be any type of storage medium that can be accessed by the processor 333 to perform various examples of the present disclosure. For example, the memory 331 can be a non-transitory computer readable medium having computer readable instructions (e.g., computer program instructions) stored thereon that are executable by the processor 333 for receiving and/or providing a notification of a fault and/or an alarm in accordance with the present disclosure.

Control panel 304 can be configured to receive a fault signal from a thermographic detector device (e.g., thermographic detector device 202, as described in FIG. 2). The fault signal can correspond to a fault associated with the thermographic detector device, and can be associated with at least one of a field of view fault, an operating parameter fault, an internal fault, and a transmission fault, as previously described herein. Upon receiving the fault signal, control panel 304 can provide a notification of the fault using the fault signal.

In some examples, control panel 304 can be configured to determine the type of the detected fault, where the type is one of a field of view fault, an operating parameter fault, an internal fault, a power supply fault, and a transmission fault. Upon detecting the type of the fault, control panel 304 can provide a notification of the detected fault that includes the type of the detected fault.

Control panel 304 can be configured to receive an alarm signal from a thermographic detector device (e.g., thermographic detector device 202, as described in FIG. 2). The alarm signal can be associated with the detection of an emergency situation (e.g., the detection of flames within a thermal image captured by the thermographic detector device). Upon receiving the alarm signal, control panel 304 can provide a notification of the emergency situation (e.g., flames) using the alarm signal. Control panel 304 may also receive the thermal image from the thermographic detector device.

As shown in FIG. 3, control panel 304 can include a user interface 334. A user can interact with control panel 304 via user interface 334. For example, user interface 334 can provide (e.g., display) information to and/or receive information from (e.g., input by) the user of the computing device. For instance, control panel 304 can provide a visual and/or audio notification of the fault or emergency situation via user interface 334. The notification can be provided using the received fault and/or alarm signal. Control panel 304 may also display the thermal image received from the thermographic detector device. This can allow a user to visualize the area monitored by the thermographic detector device during the emergency situation (e.g., the location of the emergency situation).

The fault and/or alarm signal can be transmitted via one of a plurality of transmission paths (e.g., transmission paths 118-1, 118-2, . . . , 118-N, as described in FIG. 1) within the fire alarm control system. This can allow for a user to be notified that a thermographic detector device and/or a separate component (e.g., a transmission path, a power source, an alarm signaling device, etc.) is not operating properly or that an emergency situation has been detected within the facility.

Control panel 304 can also transmit data associated with the operation of a thermographic detector device to a separate component of the fire alarm control system. For example, control panel 304 can receive video information from a thermographic detector device and send the video information to the separate components, such as a control function, fire protection equipment, and an alarm annunciation panel, as described in connection with FIG. 1. However, embodiments of the present disclosure are not limited to a particular type(s) of components of the fire alarm control system. The video information can include images (e.g., picture snapshots or live video) that can allow a user to visualize the area monitored by the thermographic detector device.

Control panel 304 can also transmit data associated with an emergency situation, including the real-time videos and/or audio data captured by the thermographic detector device, to users, such as Fire and Rescue Services or a local fire brigade via a secure connection. For example, a computing device (e.g., laptop, smart phone, tablet, etc.) can be configured to provide information associated with a detected emergency situation to a user. The computing device can be located remotely from the facility in which control panel 304 and thermographic detectors are installed allowing for a user to more easily monitor the thermographic detector devices. The control panel 304 can send the alarm signal and/or video information to the computing device. The alarm signal can include information associated with the emergency situation, including a location of a fire and a magnitude, speed, and direction of the fire. Information associated with the emergency situation can also indicate if occupants are present in an evacuated area of a facility. For instance, the thermal capabilities of the thermographic detector device to see through smoke and detect body temperature, can allow for the detection of occupants in the evacuated area of the facility. Additionally, the computing device can receive and display the thermal images captured by the thermographic detector devices. This can allow a user to visualize the area monitored by the thermographic detector devices. Thus, an emergency situation can be more easily and safely monitored.

Figure 4A:
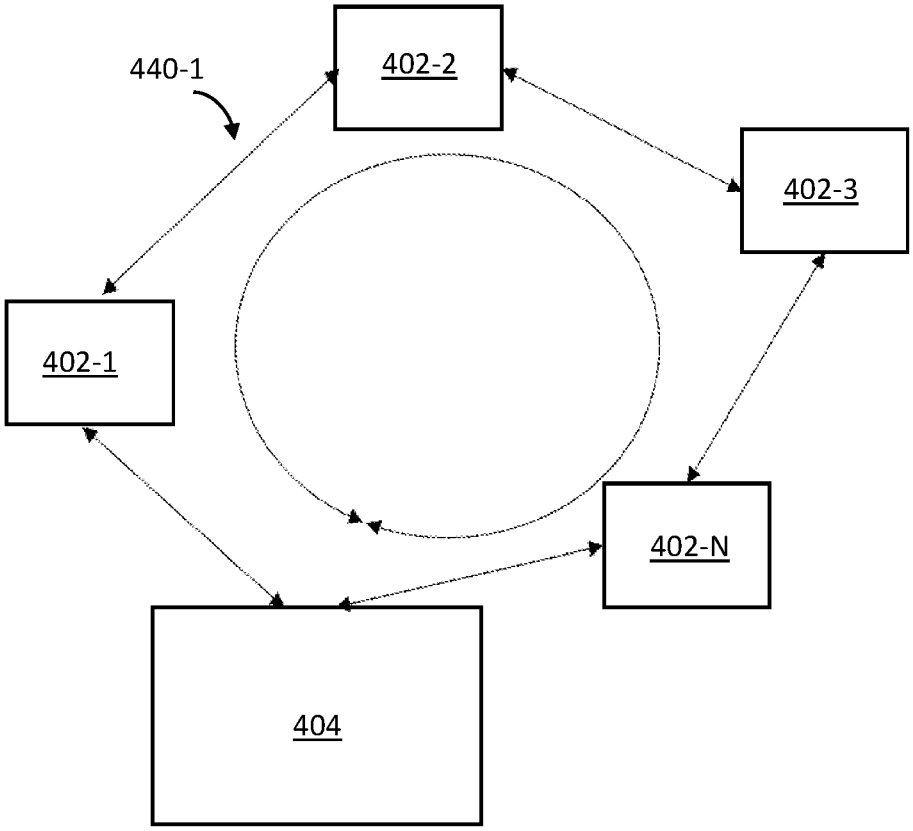
FIGS. 4A-4B are example illustrations of loop communication systems for use with a control panel, in accordance with one or more embodiments of the present disclosure.
Figure 4B:
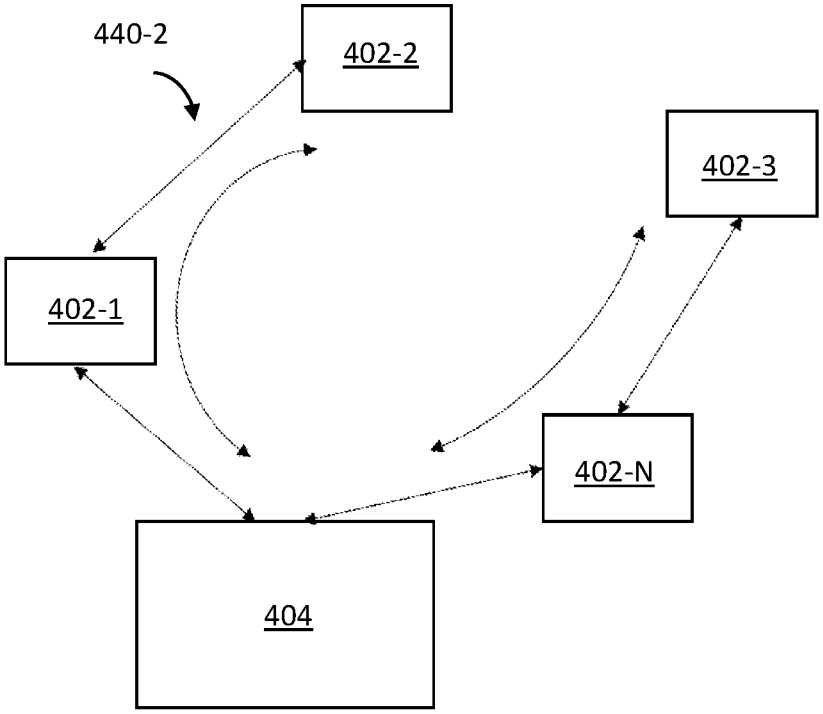

FIGS. 4A-4B are example illustrations of loop communication systems for use with control panel 404, in accordance with one or more embodiments of the present disclosure. Control panel 404 can be, for instance, control panel 104 previously described in connection with FIG. 1.

In order to ensure a failsafe operation, transmission paths within the fire alarm control system can operate as a class A communication transmission path. Class A communication can cause the generation of a fault signal in an instance where a transmission path is interrupted or if a communication between components of the fire alarm control system is disturbed. Additionally, a single interruption of the transmission path may not prevent communication and alarm and/or fault signal can still be transmitted.

FIG. 4A is an example of an uninterrupted class A communication transmission path 440-1. As shown in FIG. 4A, there is an uninterrupted transmission path 440-1 among control panel 404 and thermographic detector devices 402-1, 402-2, 402-3, . . . , 402-N. Thus, control panel 404 and thermographic detector devices 402-1, 402-2, 402-3, . . . , 402-N can transmit alarm and/or fault signals without any interruption.

FIG. 4B is an example of an interrupted class A communication transmission path 440-2. As shown in FIG. 4B, there is a single interruption in the transmission path 440-2 among control panel 404 and thermographic detector devices 402-1, 402-2, 402-3, . . . , 402-N. In such a case, control panel 404 and thermographic detector devices 402-1, 402-2, 402-3, . . . , 402-N can still transmit alarm and/or fault signals without any interruption.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A control panel for a fire alarm control system, comprising:

a memory; and a processor configured to execute instructions stored in the memory to:

receive a fault signal from a thermographic detector device, wherein the fault signal corresponds to a fault associated with the thermographic detector device;

determine a type of the fault associated with the thermographic detector device, wherein the determined type of the fault is an alteration of a focal length of a lens of the thermographic detector device that is detected by comparing a series of images collected over a period of time by the thermographic detector device to an image collected at a time of commission by the thermographic device; and provide a notification of the fault using the fault signal, wherein the notification includes an indication of the determined type of the fault that is sent, via a wireless network, from the control panel to a computing device located remotely from a facility in which the control panel is installed.

2. The control panel of claim 1, wherein the processor is configured to execute the instructions to:

receive an alarm signal from the thermographic detector device, wherein the alarm signal corresponds to flames detected by the thermographic detector device; and provide a notification of the flames using the alarm signal.

3. The control panel of claim 2, wherein the alarm signal includes information associated with fire, including at least one of a location, a magnitude, a speed, and a direction of the fire.

4. The control panel of claim 2, wherein the processor is configured to execute the instructions to send the alarm signal to the computing device.

5. The control panel of claim 1, wherein the processor is configured to execute the instructions to:

receive a thermal image from the thermographic detector device; and display the thermal image.

6. The control panel of claim 1, wherein the processor is configured to execute the instructions to detect a power supply fault associated with at least one of the control panel and the thermographic detector device.

7. The control panel of claim 1, wherein the processor is configured to execute the instructions to detect a connectivity fault between the control panel and the thermographic detector device.

8. A non-transitory computer readable medium having computer readable instructions stored thereon that are executable by a processor to:

receive, at a control panel for a fire alarm control system, a fault signal from a thermographic detector device, wherein the fault signal corresponds to a fault associated with the thermographic detector device;

determine a type of the fault, wherein the determined type is an alteration of a focal length of a lens of the thermographic detector device that is detected by comparing a series of images collected over a period of time by the thermographic detector device to an image collected at a time of commission by the thermographic device; and provide a notification of the fault that includes an indication of the determined type of the fault that is sent, via a wireless network, from the control panel to a computing device located remotely from a facility in which the control panel is installed.

9. The medium of claim 8, wherein the instructions are executable by the processor to detect a failure associated with a connection between the thermographic detector device and the control panel.

10. The medium of claim 8, wherein the instructions are executable by the processor to receive the fault signal via a class A transmission path.

11. The medium of claim 8, wherein the instructions are executable by the processor to receive a detected temperature from the thermographic detector device.

12. A fire alarm control system, comprising:

a thermographic detector device to capture a thermal image; and a control panel configured to:

receive a fault signal from the thermographic detector device, wherein the fault signal corresponds to a fault associated with the thermographic detector device;

determine a type of the fault associated with the thermographic detector device, wherein the determined type of the fault is an alteration of a focal length of a lens of the thermographic detector device that is detected by comparing a series of images collected over a period of time by the thermographic detector device to an image collected at a time of commission by the thermographic device;

provide a notification of the fault using the fault signal, wherein the notification includes an indication of the determined type of the fault that is sent, via a wireless network, from the control panel to a computing device located remotely from a facility in which the control panel is installed;

receive an alarm signal and the thermal image from the thermographic detector device, wherein the thermal image includes flames;

provide at least one of a visual and an audio notification using the alarm signal; and display the thermal image.

13. The fire alarm control system of claim 12, wherein the control panel and the thermographic detector device are communicatively coupled via a class A transmission path.

14. The fire alarm control system of claim 12, wherein the control panel is configured to instruct an alarm annunciation panel to provide a visual notification of an emergency situation.

15. The fire alarm control system of claim 12, wherein a connection between the thermographic detector device and the fire alarm control panel includes a fault circuit for generating the fault signal.

16. The fire alarm control system of claim 12, wherein a connection between the thermographic detector device and the control panel includes an alarm circuit for generating the alarm signal and providing a notification of the alarm using the alarm signal.

17. The fire alarm control system of claim 12, wherein the fire alarm control system includes a plurality of thermographic detector devices distributed throughout a facility, and the control panel is configured to:

receive an alarm signal and a thermal image from at least one of the plurality of thermographic detector devices, wherein the thermal image includes flames;

provide at least one of a visual and an audio notification using the alarm signal; and display the thermal image.

18. The fire alarm control system of claim 12, wherein the control panel is configured to instruct a fire signaling device to provide the visual and/or audio notification.

19. The fire alarm control system of claim 12, wherein the control panel includes a primary power supply configured to provide power to the thermographic detector device via a transmission path.

20. The fire alarm control system of claim 19, wherein the fire alarm control system includes a backup power supply located remotely from the control panel and the thermographic detector device, and wherein the backup power supply is configured to provide power to the thermographic detector device upon a failure of the primary power supply.

* * * * *